US009052694B2

(12) United States Patent
Tu

(10) Patent No.: US 9,052,694 B2
(45) Date of Patent: Jun. 9, 2015

(54) ESCAPEMENT DEVICE FOR TIMEPIECE

(75) Inventor: Xuan Mai Tu, Ecublens (CH)

(73) Assignee: DETRA SA, Préverenges (CH)

( * ) Notice: Subject to any disclaimer, the term of this patent is extended or adjusted under 35 U.S.C. 154(b) by 0 days.

(21) Appl. No.: 14/405,252

(22) PCT Filed: Jun. 7, 2012

(86) PCT No.: PCT/EP2012/060825
§ 371 (c)(1),
(2), (4) Date: Dec. 3, 2014

(87) PCT Pub. No.: WO2013/182243
PCT Pub. Date: Dec. 12, 2013

(65) Prior Publication Data

US 2015/0131414 A1 May 14, 2015

(51) Int. Cl.
*G04B 15/02* (2006.01)
*G04B 15/14* (2006.01)
*G04B 15/04* (2006.01)

(52) U.S. Cl.
CPC ..... *G04B 15/14* (2013.01); *G04B 15/04* (2013.01)

(58) Field of Classification Search
CPC ..... G04C 3/061; G04B 11/04; G04B 15/02; G04B 15/06; G04B 15/14
USPC ..... 368/127–133
See application file for complete search history.

(56) References Cited

U.S. PATENT DOCUMENTS

| | | | | |
|---|---|---|---|---|
| 6,301,981 | B1 * | 10/2001 | Oechslin | 74/1.5 |
| 6,802,645 | B2 * | 10/2004 | Ludwig | 368/127 |
| 8,579,498 | B2 | 11/2013 | Ferrara et al. | |
| 2006/0221774 | A1 * | 10/2006 | Conus et al. | 368/127 |
| 2006/0221775 | A1 * | 10/2006 | Zaugg | 368/127 |
| 2008/0219104 | A1 * | 9/2008 | Jurin et al. | 368/132 |
| 2008/0259737 | A1 * | 10/2008 | Cabezas Jurin et al. | 368/127 |
| 2013/0176830 | A1 | 7/2013 | Ferrara et al. | |

FOREIGN PATENT DOCUMENTS

| | | |
|---|---|---|
| CH | 702 313 | 6/2011 |
| EP | 0 018 796 | 11/1980 |
| EP | 1 276 021 | 1/2003 |
| FR | 2 928 015 | 8/2009 |
| WO | WO 2011/064682 | 6/2011 |

OTHER PUBLICATIONS

PCT/EP2012/060825 International Search Report dated Feb. 28, 2013 (4 pages).

* cited by examiner

*Primary Examiner* — Sean Kayes
(74) *Attorney, Agent, or Firm* — Brinks Gilson & Lione; G. Peter Nichols

(57) ABSTRACT

Escapement device of a timepiece movement includes an escapement wheel, a first mobile having means of locking with the escapement wheel and of mechanical transmission with the escapement wheel, a second mobile and the balance roller. The second mobile has means of locking with the escapement wheel and means of mechanical transmission with the escapement wheel and the first mobile. The mobiles are driven by the escapement wheel tangentially.

8 Claims, 10 Drawing Sheets

ESCAPEMENT DEVICE FOR TIMEPIECE

This application claims priority to International Application No. PCT/EP2012/060825 filed Jun. 7, 2012; the entire content is incorporated herein by reference.

BACKGROUND

The present invention relates to an escapement device for clockwork, particularly for a wristwatch of the spiral balance type.

SUMMARY

The escapement device in a mechanical watch is the master part designed, on the one hand, to deliver the necessary energy for maintaining the oscillatory motion of the mechanical oscillator, and on the other hand to transmit the frequency of oscillation to the gear train driving the time display.

The most widely used escapement device is currently the Swiss lever escapement. This type of escapement has been the subject of numerous studies and publications. The manual entitled "Théorie d'horlogerie" [Clockwork Theory], published by the Federation of Swiss Technical Schools, as well as the manual "Echappement et moteurs pas à pas" [Escapements and Stepping Motors] from the same publisher, describe in detail the operation of this type of escapement. The major drawbacks of this type of escapement are:

low efficiency: best efficiency is on the order of 30% to 40%;

manufacturing difficulties: to obtain the aforementioned efficiencies, the Swiss lever requires several highly precise final fine-tuning steps;

limited operating frequency: driving of the lever by the escape wheel is not tangential; during the mechanical impulse, the tooth of the escape wheel slides along the lever pallet, which leads to a wear problem for high operating frequencies.

To resolve the wear problem, patent EP 0 018796 A2 proposes a tangential drive type of escapement. The disadvantage of this type of escapement is the necessity of using two stacked wheels, which increases the inertia of the escapement and consequently reduces efficiency; moreover, the number of highly precise final fine-tuning steps is as great as that of a Swiss lever escapement.

Another type of tangential drive escapement well known in the literature is the detent escapement. This type of escapement has one active alternation, that is the escape wheel advances and delivers the mechanical impulse once per period of oscillation of the spiral balance wheel.

The aim of the present invention is to correct the flaws of the known escapements mentioned above by proposing a tangential drive escapement device with two active alternations per period of oscillation, with a single escape wheel and which nevertheless consumes less energy in its operation than the Swiss lever escapement.

To this end, the escapement as defined in Claim 1 has only one escape wheel and, thanks to the outside angles of each mobile which run from the locking face toward the driving face and which have the same direction as the principal direction of rotation of the escape wheel (during the impulse phase), the operation requires less energy because friction is reduced between the escape wheel and each mobile. In other words, the locking and driving faces of each mobile are arranged such that, during the driving or impulse phase, the escape wheel and the mobile then in contact with the escape wheel have opposite directions of rotation; the drive during the impulse phase is tangential. The escapement according to the present invention is therefore simple because it only has one escape wheel, but increases the operating reserve and can be used at high oscillation frequencies. It can also be noted that, according to this arrangement, transmission of energy from the escape wheel to the balance is effective.

DETAILED DESCRIPTION

In the present application, reference will be made to outside angles which are measured in the same direction as that traveled by the point of contact between the escape wheel and the mobile body considered. In the present application, this comes down to saying that the direction in which this angle is measured is opposite to the direction of rotation considered when releasing the escape wheel.

Figure 1:
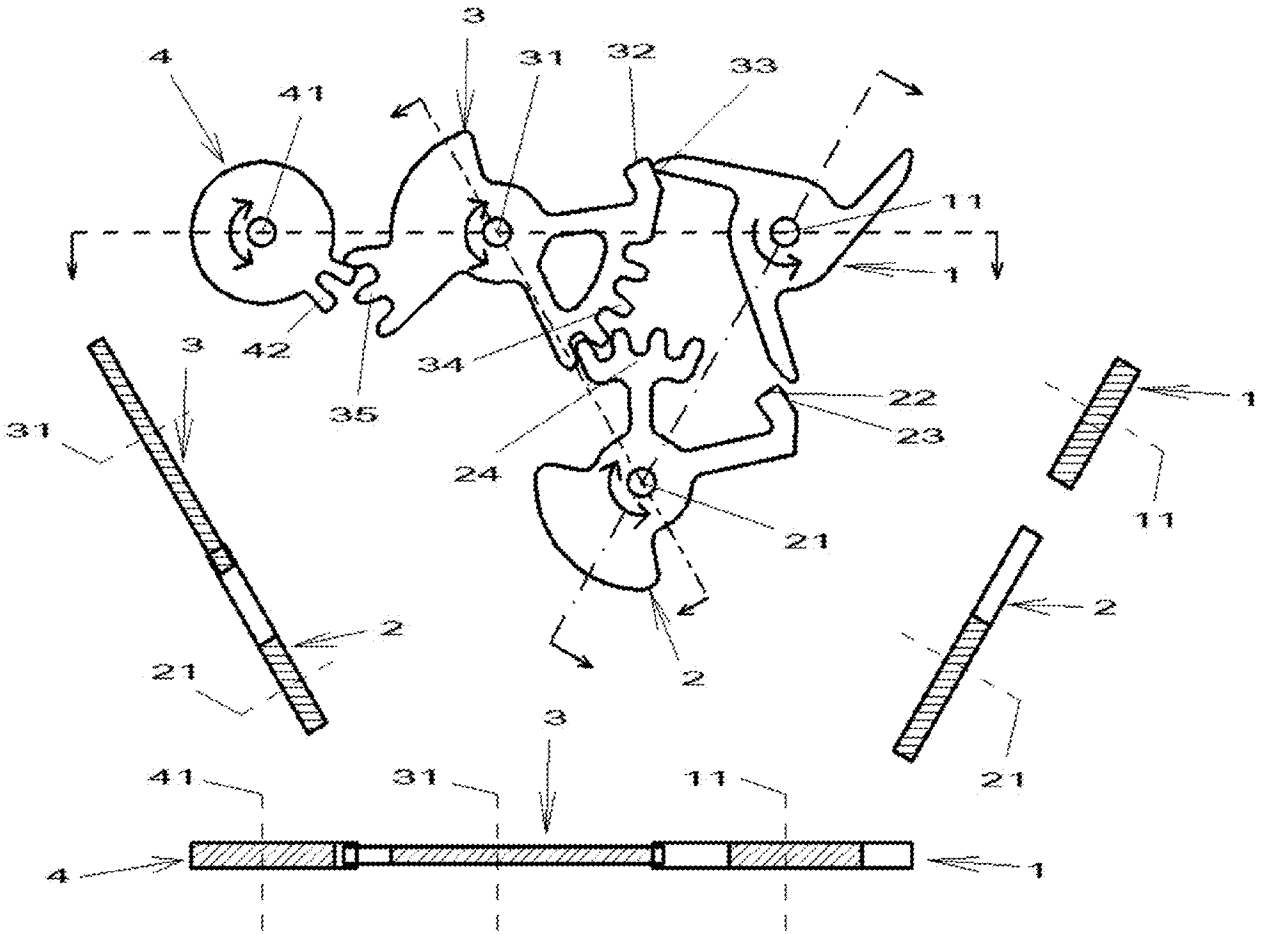
FIG. 1 shows a general plan view of an embodiment of the escapement device according to the invention.

One embodiment of the escapement device according to the invention is shown in FIG. 1, in plan and in elevation in 3 section planes shown in broken lines. The escapement device according to FIG. 1 includes:

an escape wheel 1 driven by the barrel through the transmission wheels; this escape wheel rotates about the axis 11 in the counter-clockwise direction;

a mobile 2 pivoting about the axis 21, comprising a first toothed structure with impulse faces 22 and locking faces 23 as well as a second toothed structure 24;

a mobile 3 pivoting about the axis 31, comprising a first toothed structure with impulse faces 32 and locking faces 33, a second toothed structure 34 and a third toothed structure 35.

Though it is not directly a part of the escapement device, FIG. 1 also shows the plate of the balance 4 pivoting about the axis 41 and comprising the toothed structure 42.

The following figures describe the principal operating steps of the escapement device according to the invention.

Figure 2:
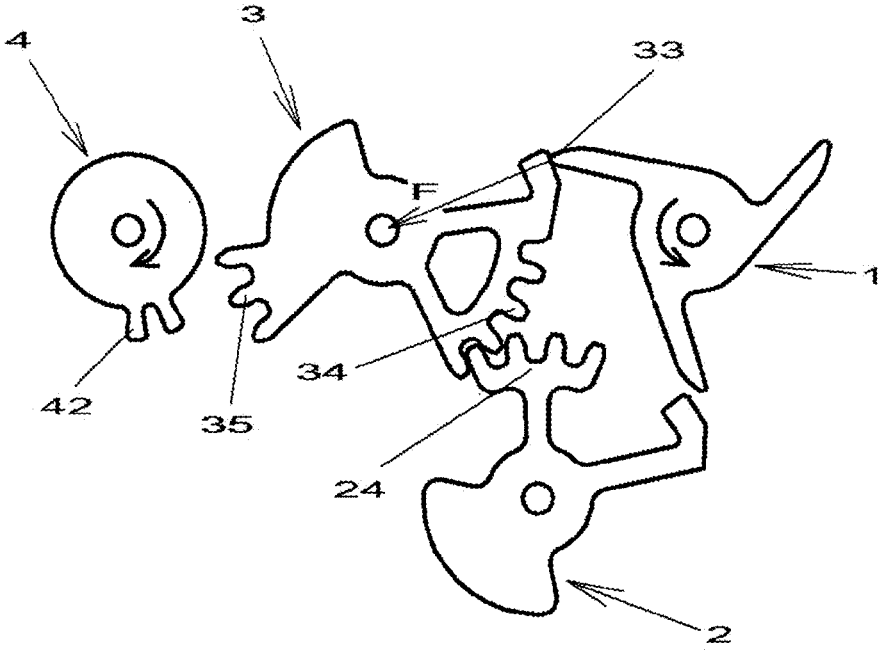
FIG. 2 shows the first rest position of the escapement of FIG. 1.

FIG. 2 shows the first rest position of the escapement of FIG. 1.

In this figure, the balance is turning clockwise. The toothed structure 42 of the balance is moving away from the toothed structure 35 of the mobile 3. The tooth of the escape wheel 1, under the influence of the barrel torque, exerts a force F on the locking face 33 of the mobile 3. This locking face 33 is arranged so that the direction of the force F passes substantially in proximity to the center of the mobile 3. Under these conditions, the escape wheel is locked and consequently immobilizes the mobile 3 and the mobile 2 by way of the toothed structures 24 and 34.

Figure 3:
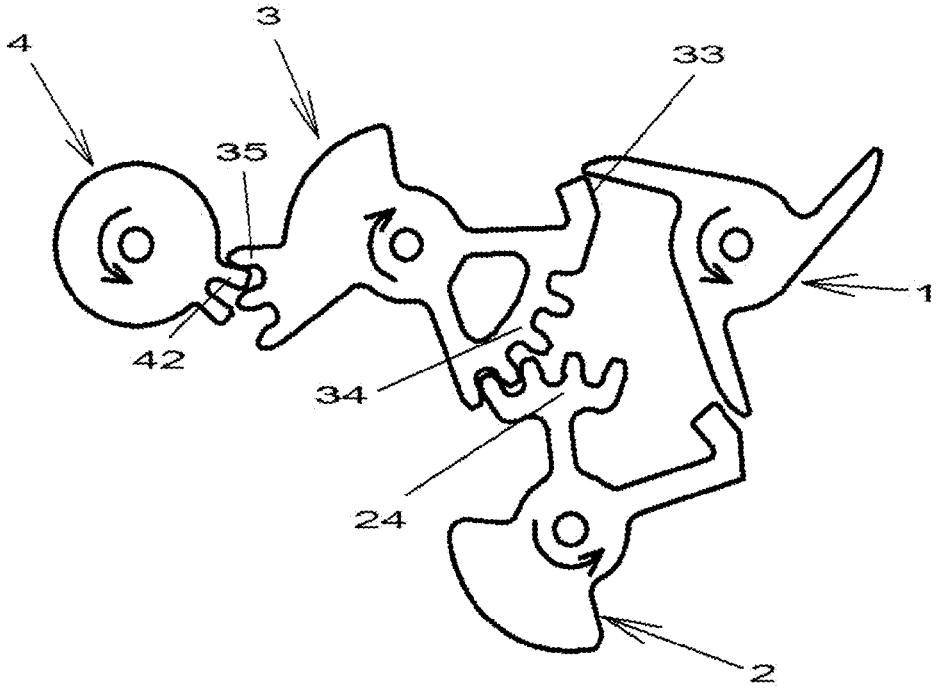
FIG. 3 shows the position of the escapement of FIG. 1 just after disengaging from the first rest position.
Figure 6:
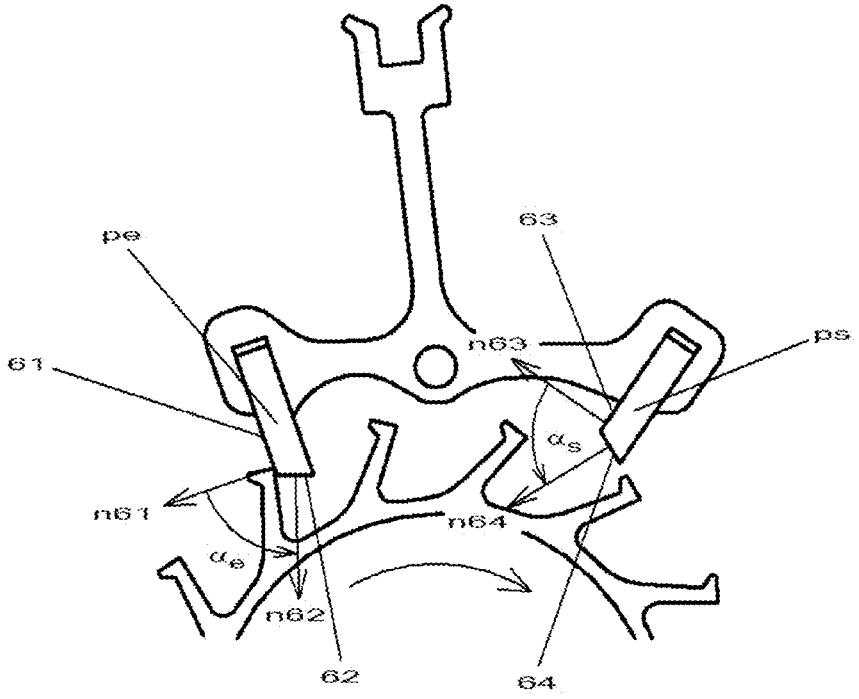
FIG. 6 shows the outside angle $\alpha e$ between the surface normals n61 and 62 of the input pallet as well as the outside angle $\alpha s$ between the surface normals n63 and 64 of the output pallet of a Swiss lever escapement.

FIG. 3 shows the position of the escapement of FIG. 6 just after leaving the first rest position.

In this figure, the balance is turning counter-clockwise. The toothed structure 42 of the balance comes into contact with the toothed structure 35 and causes the mobile 3 to turn clockwise. This action frees the tooth of the escape wheel from the locking face 33. The necessary mechanical energy for disengaging is extremely small because it is used only to overcome the friction of the escape wheel on the locking face 33 and to displace the mobiles 2 and 3 a few degrees. In this application example, the angular displacement of the mobiles 2 and 3 during disengagement is about 4 degrees.

Figure 4:
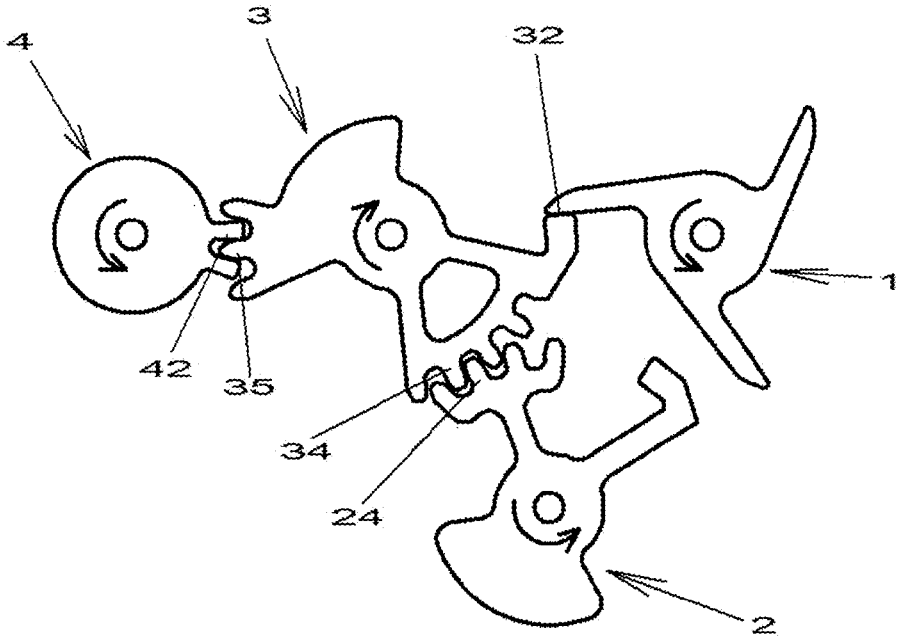
FIG. 4 shows the phase of energy transmission from the escape wheel to the balance when the latter rotates in the counter-clockwise direction.

FIG. 4 shows the phase of energy transmission from the escape wheel to the balance when the latter is turning counter-clockwise.

In this figure, the tooth of the escape wheel 1 presses on the impulse face 32 and drives the mobile 3 in the clockwise direction. The mechanical energy of the escape wheel is transmitted to the balance thanks to the toothed structures 42 and 35. The mobile 2 is also driven by the mobile 3 by the toothed structures 34 and 24. It is noted that, unlike a Swiss lever escapement, the driving of the mobile 3 by the escape wheel is substantially tangential to the trajectory of the impulse face 32.

The tangential driving of the mobile 3 by the escape wheel is obtained thanks to the particular arrangement of the faces 33 and 32 of the mobile 3.

Figure 5:
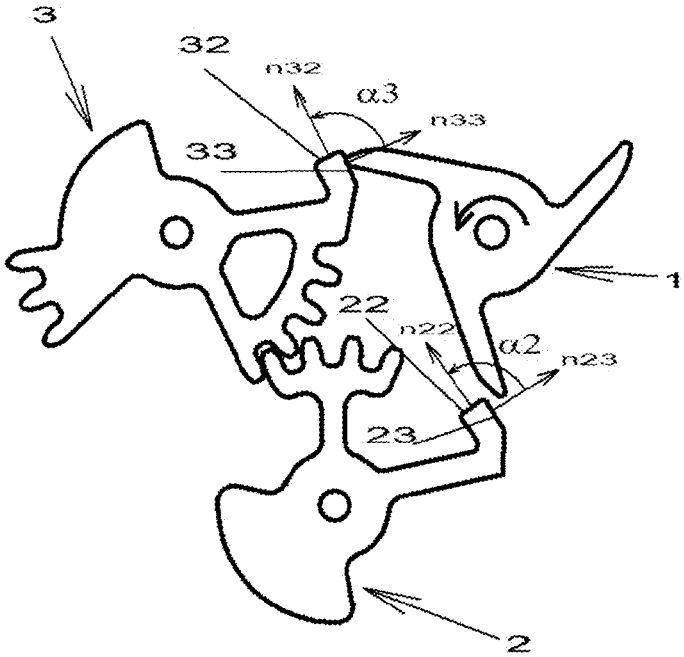
FIG. 5 shows mobiles 2 and 3 and the escape wheel 1 in the first rest position.

FIG. 5 shows the mobiles 2 and 3 as well as the escape wheel 1 in the first rest position.

The vector n33 represents the surface normal (hereafter called "normal") to the locking face 33 at the locking point of the tooth of the escape wheel, the vector n32 represents the normal passing through the center of the impulse face 32 of the mobile 3 and $\alpha$3 represents the outside angle between n33 and n32.

One of the particular characteristics of the escapement according to the invention is manifested by an outside angle $\alpha$3 having the same sign as that of the angle of rotation of the escape wheel. In this exemplary embodiment, the outside angle $\alpha$3 and the angle of rotation of the escape wheel are positive with respect to the trigonometric direction.

These characteristics are also found on the outside angle $\alpha$2 between the normal n23 to the locking face 23 and the normal n22 to the impulse face 22 of the mobile 2.

By way of comparison, FIG. 6 shows the outside angle $\alpha e$ between the normal n61 to the locking face 61 and the normal n62 to the impulse face 62 of the input pallet, as well as the outside angle $\alpha s$ between the normal n63 to the locking face 63 and the normal n64 to the impulse face 64 of the output pallet, of a Swiss lever escapement.

It is observed that the outside angles $\alpha e$ and $\alpha s$ are of opposite sign to that of the angle of rotation of the escape wheel.

Figure 7:
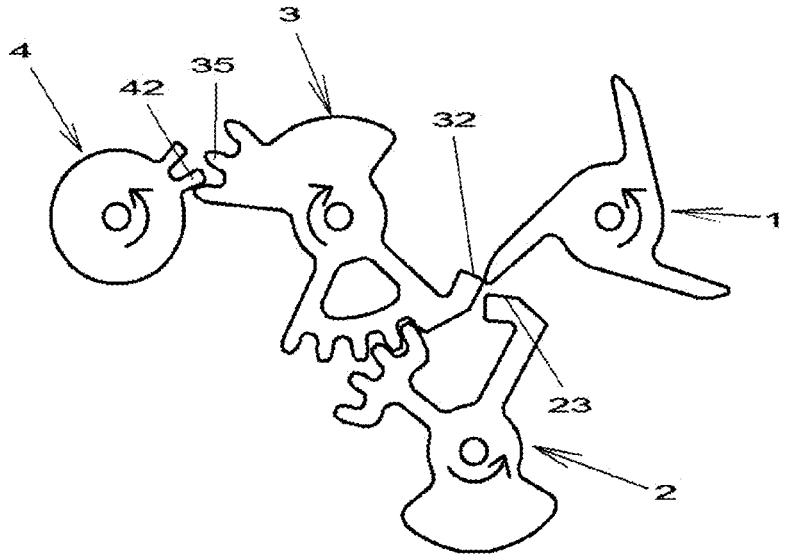
FIG. 7 shows the end of the phase of energy transmission from the escape wheel to the balance when the latter is turning in the counter-clockwise direction.

FIG. 7 shows the end of the phase of energy transmission from the escape wheel to the balance when the latter is turning counter-clockwise. In this end of the energy transmission phase, the tooth of the escape wheel leaves the impulse face 32 of the mobile 3 and the locking face 23 of the mobile 2 is positioned facing the tooth of the escape wheel 1. During this time, the balance follows its supplementary oscillation arc while moving its toothed structure 42 away from the toothed structure 35 of the mobile 3.

Figure 8:
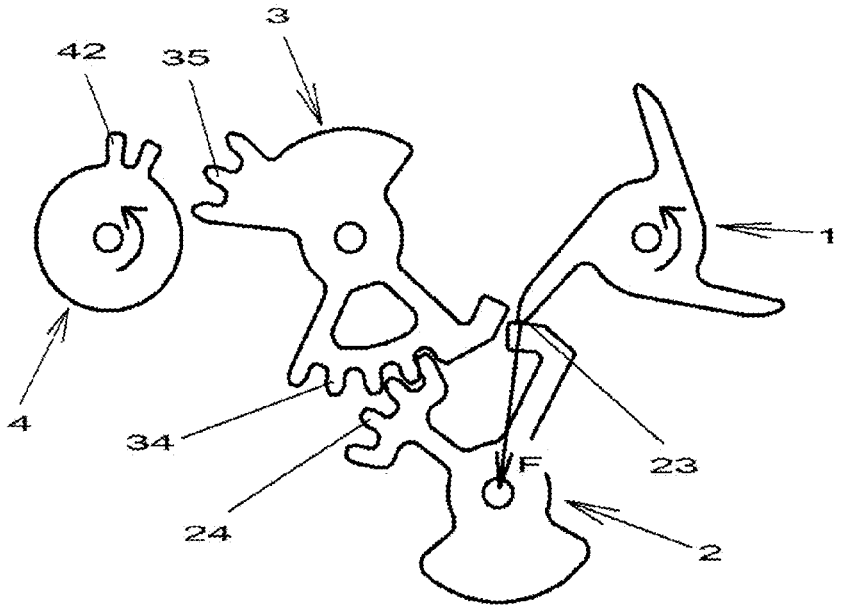
FIG. 8 shows the second rest position of the escapement of FIG. 1.

FIG. 8 shows the second rest position of the escapement of FIG. 1.

In this figure, the balance is turning counter-clockwise. The toothed structure 42 of the balance is moving away from the toothed structure 35 of the mobile 3. The tooth of the escape wheel 1, under the influence of the barrel torque, exerts a force F on the locking face 23 of the mobile 2. This locking face 23 is arranged so that the direction of the force F passes substantially in proximity to the center of the mobile 2; consequently, the escape wheel is locked and immobilizes the mobile 2 as well as the mobile 3 by way of the toothed structures 24 and 34.

The phases of engagement, of energy transmission and the end of the energy transmission when the balance is turning clockwise are manifest in similar fashion to those already presented when the balance is turning counter-clockwise.

Figure 9:
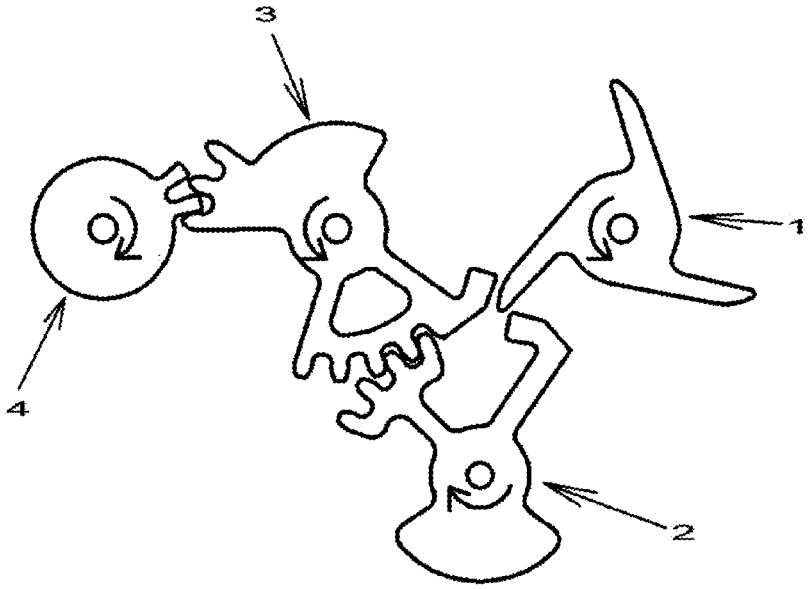
FIG. 9 shows the position of the escapement of FIG. 1 just after disengaging from the second rest position.
Figure 10:
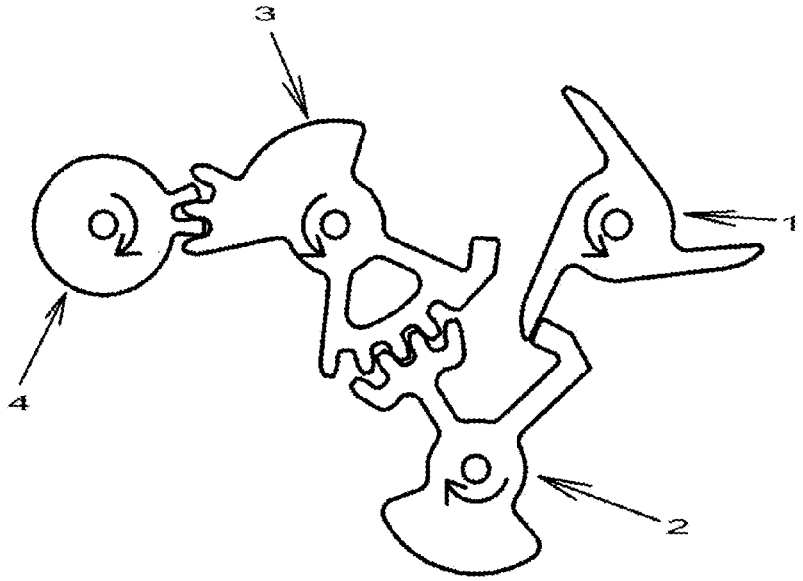
FIG. 10 shows the phase of energy transmission from the escape wheel to the balance when the latter is turning clockwise.
Figure 11:
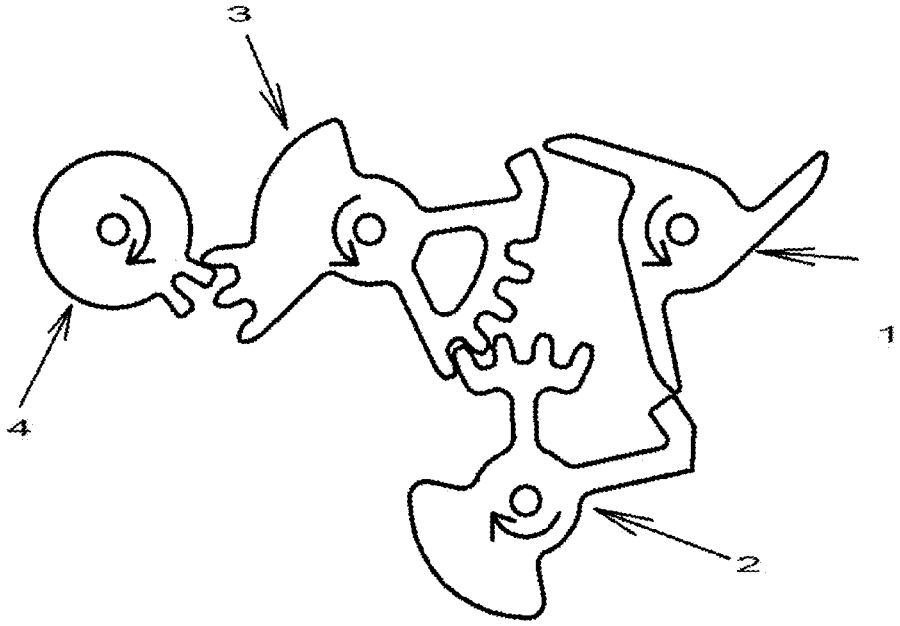
FIG. 11 shows the end of the phase of energy transmission from the escape wheel to the balance when the latter is turning clockwise.

The following figures illustrate these different phases:

FIG. 9 shows the position of the escapement of FIG. 1 just after disengaging from the second rest position;

FIG. 10 shows the phase of energy transmission from the escape wheel to the balance when the latter is turning clockwise;

FIG. 11 shows the end of the phase of energy transmission from the escape wheel to the balance when the latter is turning clockwise.

After this energy transmission phase in the clockwise direction, the escape wheel is again locked at the locking face 33 and the operating cycle begins again.

It is observed that the escapement device according to the invention has two active alternations per period of oscillation of the spiral balance and that the escape wheel advances at each alternation by an angle equal to 180°/N, N being the number of teeth of the escape wheel; moreover, the same tooth of the escape wheel is successively locked on the locking face 33 and 23. It can be deduced that the angle between the locking points on the faces 33 and 23 with respect to the center of rotation of the escape wheel is also equal to 180°/N.

Figure 12:
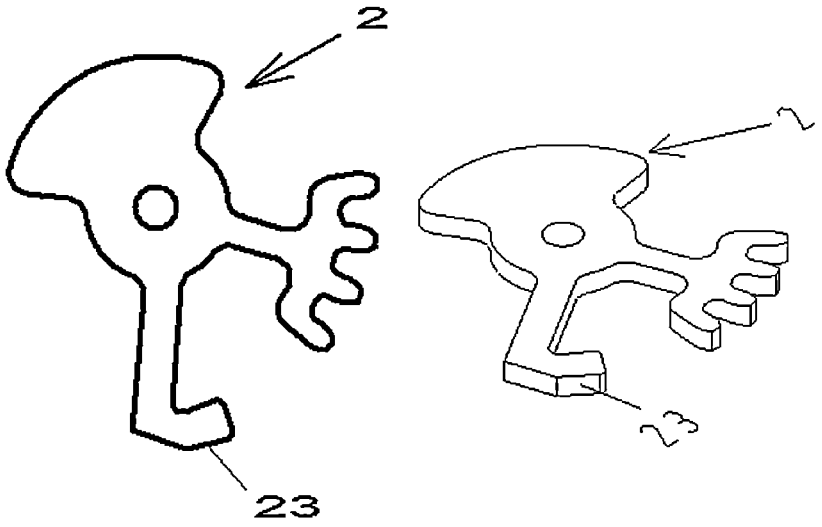
FIG. 12 shows the mobile 2 of the escapement device of FIG. 1.

FIG. 12 shows, in plan and in perspective, the mobile 2 of the escapement of FIG. 1.

In this exemplary embodiment the locking face 23 consists of a plane the normal to which at the locking point passes substantially in proximity to the center of rotation of the mobile 2. It is also possible to obtain the same effect by replacing this plane by a cylindrical surface the cylinder axis whereof passes through the center of rotation of the mobile 2. However, if the abovementioned surfaces allow locking of the escape wheel, they do not make it possible to guarantee with precision the locking position, due to the rebound due to the impact between the tooth of the escape wheel and the locking face, at the end of the energy transmission phase and just before the rest phase.

Figure 13:
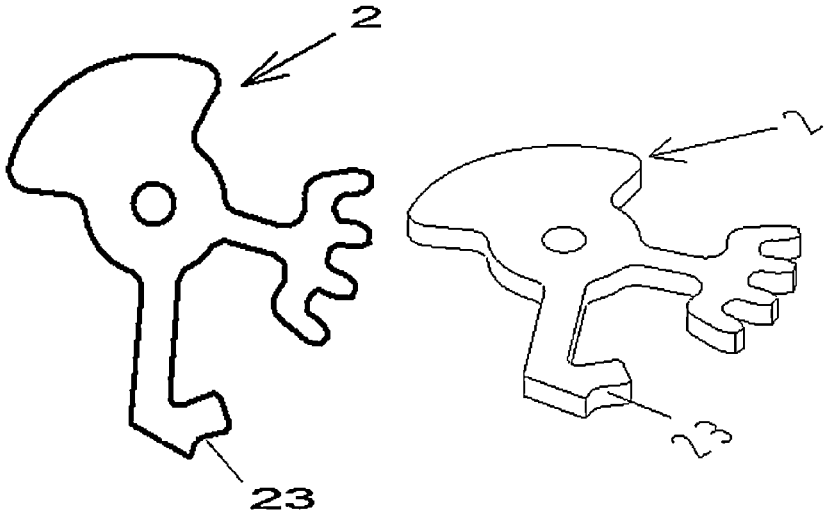
FIG. 13 shows a variant embodiment of the locking face 23 of the mobile 2.
Figure 14:
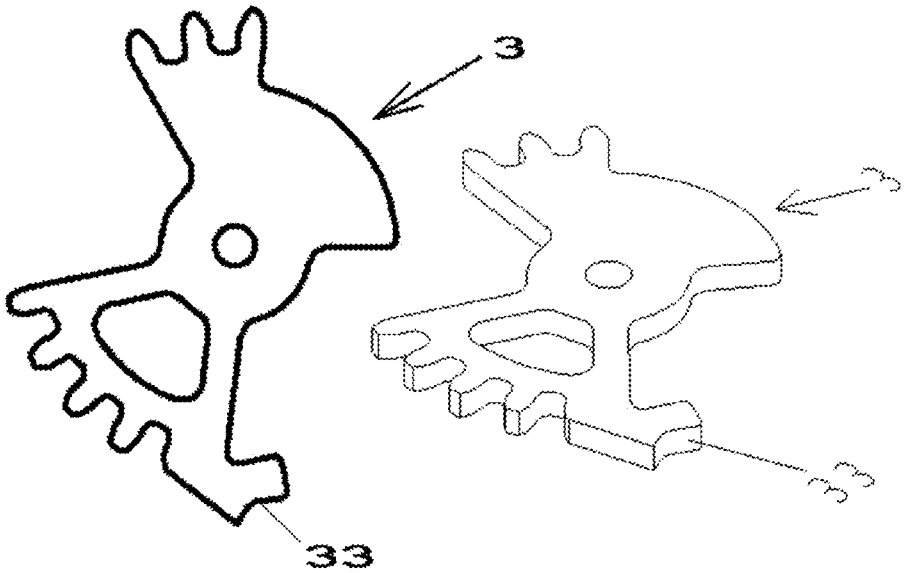
FIG. 14 shows a variant embodiment of the locking face 33 of the mobile 3.

To improve the precision of locking, a variant embodiment of the locking face 23, shown in FIG. 13, consists of replacing this plane by a concave surface.

Figure 15:
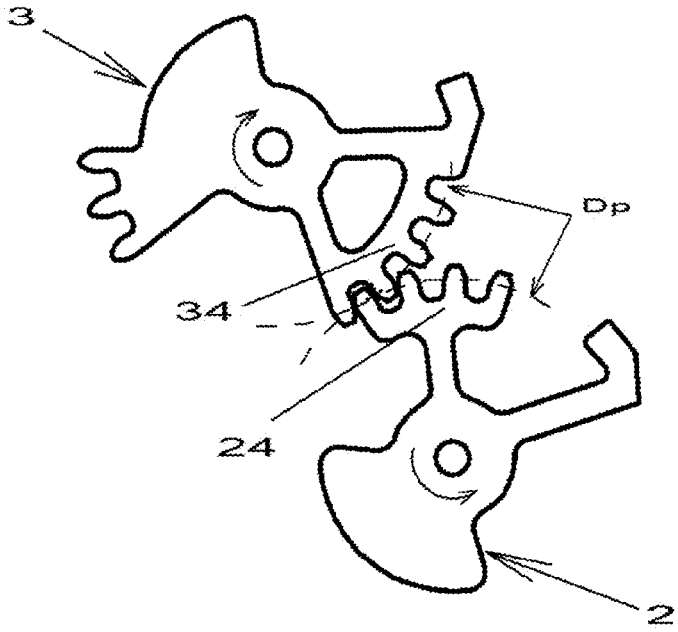
FIG. 15 shows the case where the pitch diameters of each mobile 2 and 3 are equal.

FIG. 15 shows the case where the pitch diameters (Dp) of the gears 24 and 34 are equal, so as to minimize the differences in inertia between the two mobiles 2 and 3.

Figure 16:
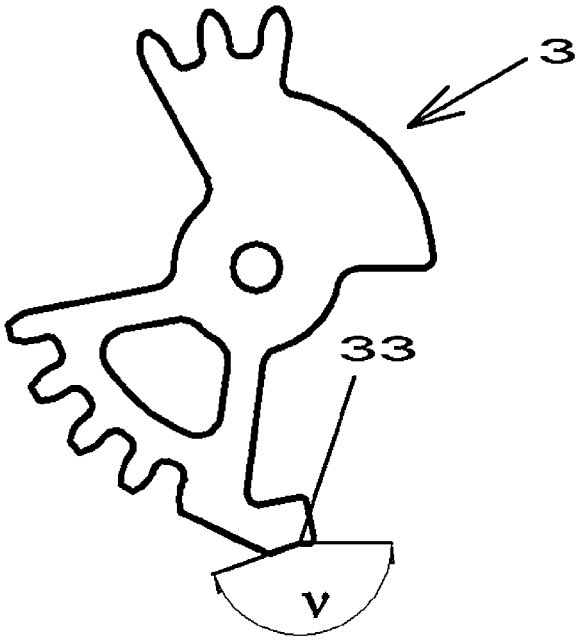
FIG. 16 shows a variant of the locking face of the second mobile.
Figure 17:
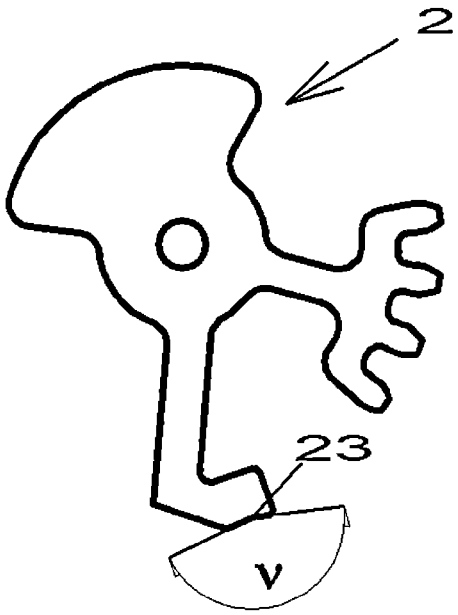
FIG. 17 shows a variant of the locking face of the first mobile.

FIGS. 16 and 17 show a variant of the locking face, respectively of the first and of the second mobile, where these surfaces are concave and consist of two secant planes inclined at an angle v, so as to offer secure locking in the event of an impact or a rebound of the escape wheel 1 on one of the first or second mobiles 2 or 3. With this implementation, the relative angular position of the escape wheel 1 relative to the first and second mobiles 2 and 3 is guaranteed and there is no possibility of undesired rotation.

Figure 18:
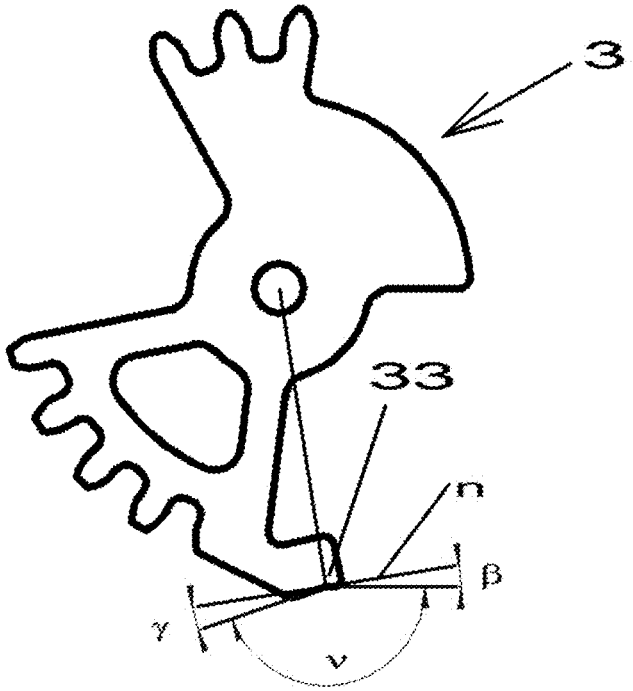
FIG. 18 shows a variant of the locking face of the second mobile.

FIG. 18 shows a variant of the locking face 33 of the second mobile. The plane n shows the plane normal to the vertical surface passing through the locking point between the second mobile 3 and the escape wheel 1 and the center of rotation of the second mobile 3. The first plane of the locking face 33 forms an angle β relative to the plane n. A nonzero angle β offers better shock resistance of the escape wheel; on the other hand it causes recoil of the escape wheel during disengagement and consequently a loss of energy on disengagement. The second locking plane forms an angle γ relative to the plane n. A high value of γ makes it possible to improve the precision of locking; on the other hand, it causes considerable rebound of the escape wheel 1 prior to locking. Different trials have shown that the value of the angle $v=180-((\beta+\gamma)$ comprised between 120° and 170° represents the best compromise between good locking security, minimal or zero rebound at the end of the impulse and minimum energy loss on disengagement.

It will be understood that various modifications and/or improvements obvious to the person skilled in the art can be applied to the different embodiments of the invention described in the present description without departing from the scope of the invention defined by the appended claims.

The invention claimed is:

1. An escapement device of a clockwork movement with two active alternations between a balance plate and an escape wheel including:

a first mobile having a first impulse face and a first locking face that cooperate with the escape wheel, a second mobile having a second impulse face and a second locking face that cooperate with the escape wheel and having gears linking the second mobile and the balance plate;

gears linking the first mobile and the second mobile;

wherein the escape wheel is subjected to an essentially constant torque, is arranged to alternately transmit mechanical energy to the first mobile and to the second mobile, and has an angle of rotation, the first locking face is arranged so that the force transmitted by the escape wheel in the first locking face passes substantially in proximity to the center of rotation of the first mobile, the second locking face is arranged so that the force transmitted by the escape wheel on the second locking face passes substantially in proximity to the center of rotation of the mobile, the first drive face is positioned adjacent to the first locking face in such a manner that an outside angle α2 running from the first locking face toward the first drive face has the same sign as that of the angle of rotation of the escape wheel, the second drive face is positioned adjacent to the second locking face in such a manner that an outside angle α3 running from the second locking face toward the second drive face has the same sign as that of the angle of rotation of the escape wheel, the first locking face and the second locking face have concave surfaces.

2. The escapement device according to claim 1, wherein the escape wheel, the first mobile, the second mobile, and the balance plate are arranged in the same median plane.

3. The escapement device according to claim 1, wherein the escape wheel has a number of teeth and an angle traveled by the escape wheel between the second locking face and the first locking face, relative to the center of rotation of the escape wheel, is equal to 180°/N.

4. The escapement device according to claim 3, wherein the number of teeth of the escape wheel is less than or equal to 6.

5. The escapement device according to claim 1, wherein the first locking face of the first mobile and the second locking face of the second mobile are cylindrical surfaces.

6. The escapement device according to claim 1, wherein the gears have the same pitch diameter.

7. The escapement device according to claim 1, wherein the first locking face of the first mobile and the second locking face of the second mobile include two planes, presenting an outside angle v between them that is between 120° and 170°.

8. A timepiece equipped with an escapement device according to claim 1.

* * * * *